US006543122B1

(12) United States Patent
Perkins et al.

(10) Patent No.: US 6,543,122 B1
(45) Date of Patent: Apr. 8, 2003

(54) PROCESS FOR PRODUCING THICK SHEET FROM DIRECT CHILL CAST COLD ROLLED ALUMINUM ALLOY

(75) Inventors: David Perkins, Nash, TX (US); Richard R. Measures, Texarkana, TX (US); Nancy Ten Eyck, Texarkana, TX (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/957,852

(22) Filed: Sep. 21, 2001

(51) Int. Cl.[7] ..... B21B 1/46; B21B 27/06

(52) U.S. Cl. ..... 29/527.7; 72/201; 148/692; 164/476

(58) Field of Search ..... 29/527.7; 72/200, 72/201; 148/692; 164/476

(56) References Cited

U.S. PATENT DOCUMENTS

| | | | |
|---|---|---|---|
| 4,282,044 | A | 8/1981 | Robertson et al. |
| 4,582,118 | A | 4/1986 | Jacoby et al. |
| 4,610,295 | A | 9/1986 | Jacoby et al. |
| 4,709,740 | A | 12/1987 | Jacoby et al. |
| 4,724,887 | A | 2/1988 | Jacoby et al. |
| 5,106,429 | A | 4/1992 | McAuliffe et al. |
| 5,329,688 | A | 7/1994 | Arvedi et al. |
| 5,356,495 | A | 10/1994 | Wyatt-Mair et al. |
| 5,363,902 | A | 11/1994 | Kush |
| 5,470,405 | A | 11/1995 | Wyatt-Mair et al. |
| 5,496,423 | A | 3/1996 | Wyatt-Mair et al. |
| 5,514,228 | A | 5/1996 | Wyatt-Mair et al. |
| 5,515,908 | A | 5/1996 | Harrington |
| 5,564,491 | A | 10/1996 | Harrington |
| 5,634,991 | A | 6/1997 | Kamat |
| 5,655,593 | A | 8/1997 | Wyatt-Mair et al. |
| 5,701,775 | A | 12/1997 | Sivilotti et al. |
| 5,742,993 | A | 4/1998 | Sun |
| 5,772,799 | A | 6/1998 | Sun et al. |
| 5,772,802 | A | 6/1998 | Sun et al. |
| 5,862,582 | A | 1/1999 | Sun |
| 5,993,573 | A | 11/1999 | Selepack et al. |
| 6,237,384 | B1 | 5/2001 | Seidel |

OTHER PUBLICATIONS

E. Herrmann & D. Hoffmann, Handbook on Continuous Casting, 1980, pp. 1–6, Aluminium–Verlag, Dusseldorf.

Kent Van Horn, Editor, Aluminum: vol. III Fabricating and Finishing, pp. 18–21, 40–42, American Society for Metals, United States.

*Primary Examiner*—P. W. Echols
(74) *Attorney, Agent, or Firm*—Daniel P. Cillo; Glenn E. Klepac

(57) ABSTRACT

A process for producing thick aluminum/aluminum alloy sheet useful for truck parts and the like includes the steps of feeding molten aluminum/aluminum alloy (10) into a direct casting apparatus (12) to provide an ingot that is subjected to a cooling (15) and optional scalping step (14), followed by hot rolling (18) to provide a sheet having a thickness for from about 3.2 mm to 5.8 mm and is suitable to coil in step (20), and where the sheet is cooled (21) to less than to 60° C. and cold rolled (22, 24) at from about 120° C. to 160° C. to reduce the sheet to about 0.9 mm to 1.5 mm to 160° C., where heat generated during the cold rolling (22, 24) stabilizes the sheet without additional energy intensive oven furnace annealing. The reduced sheet can then be trimmed (28) and coated (30) as with paint or the like.

13 Claims, 2 Drawing Sheets

PROCESS FOR PRODUCING THICK SHEET FROM DIRECT CHILL CAST COLD ROLLED ALUMINUM ALLOY

FIELD OF THE INVENTION

The present invention relates to producing thick sheet from direct chill cast aluminum alloy using major cold rolling reductions which are effective to eliminate any furnace annealing step.

BACKGROUND OF THE INVENTION

Continuous casting of aluminum is well known and taught for example in U.S. Pat. Nos. 5,106,429; 5,329,688; 5,356,495; 5,634,991; and 5,993,573 (McAuliffe et al.; Arvedi et al.; Wyatt-Maer et al.; Kamat; and Selepark et al., respectively). Most of these processes require some sort of an intermediate annealing process. Direct chill casting of aluminum is also well known and taught for example in U.S. Pat. Nos. 4,582,118; 4,610,295; 4,709,740; 4,724,887 (all Jacoby et al.) and 4,282,044 (Robertson et al.), as well as Kent R. Van Horn, *Aluminum* Vol. 3 "Fabrication and Finishing" Amer. Soc. For Metals, 1967, pp 18–20 and 40–43; and E. Herrmann et al. *Handbook on Continuous Casting*, Alcominimum-Verlag, 1980, pp. 1–6. Most of the processes also use various hot rolling and cold rolling processes to produce final sheet, for example, Seidel, in U.S. Pat. No. 6,237,384 B1 provides an additional hot roll between the end of a cooling section and coiling and Sivilotti et al. applies cooling liquid only to the lower surface of continuously moving metal strip.

Of all the steps in fabricating thin or thick metal sheet, the thermal treatment or annealing steps are extremely energy intensive. In today's energy crisis there is a need to reduce consumption of natural gas or electricity (or other energy sources) needed to heat the metal, during strip fabrication, to a temperature sufficient for stabilizing the metal.

SUMMARY OF THE INVENTION

It is one of the main objects of this invention to provide an energy efficient strip fabrication process. It is another object of this invention to eliminate the need for any furnace annealing, thereby saving energy, especially for thicker strip fabrication such as used for truck trailer skins and the like where thickness of from about 1 to 1.5 mm is required.

These and other objects are solved by providing a process for producing thick aluminum sheet consisting of: casting an aluminum alloy ingot; and then cooling and optionally scalping the ingot to provide a smooth surface suitable for hot rolling; and then heating the ingot to from 500° C. to 600° C. (930° F. to 1110° F.); and then hot rolling the ingot into a coilable sheet having a thickness of from 3.2 mm to 5.8 mm; and then wrapping the hot sheet into a coil; and then cooling the coiled sheet to less than 60° C., preferably; and then cold rolling the cooled sheet from the coil between two opposing rolls to reduce the thickness to from 0.9 mm to 1.5 mm and to provide sheet with a temperature of from 120° C. to 160° C. (250° F.–320° F.), where sufficient heat is generated during the cold rolling, to stabilize the aluminum sheet; and then wrapping the reduced sheet into a coil; and then cooling the coiled sheet, preferably, to ambient temperature. This process can use aluminum scrap as a starting material. By "stabilizing" is meant low temperature thermal treatment designed to prevent age-softening in certain strain hardened aluminum alloys containing magnesium. Preferably, the ingot is cast by well known direct chill casting.

Additional steps can include tension leveling, that is, a process designed to level, or mechanically flatten, by continuously stretching uniaxially with the assistance of bending, and trimming the edges of the sheet to a desired width and coating the sheet preferably both sides with paint or the like protective material. The heat generated from the tandem cold rolling reductions, preferably two passes, is sufficient to stabilize the aluminum sheet without having to anneal it in a furnace, adding greatly to energy savings. This cold reduction of thick sheet is essential to the process. The sheet produced is thick sheet 0.9 mm to 1.5 mm, useful for example for truck trailer sheet rather than for example cans and the like which require a sheet thickness of less than about 0.5 mm. By truck trailer sheet is meant skin sheet on the trailers of tractor trailers and other van-type mobile carriers as a trailer or truck. The sheet in this process is of such a gauge that the thickness of the hot milled coil and the passes on the cold mill do not require an intermediate anneal.

Other aspects and advantages of the invention will occur to persons skilled in the art from the following detailed description.

BRIEF DESCRIPTION OF THE DRAWINGS

For a better understanding of the invention, reference may be made to the following non-binding figures in which.

DETAILED DESCRIPTION OF PREFERRED EMBODIMENTS

Figure 1:
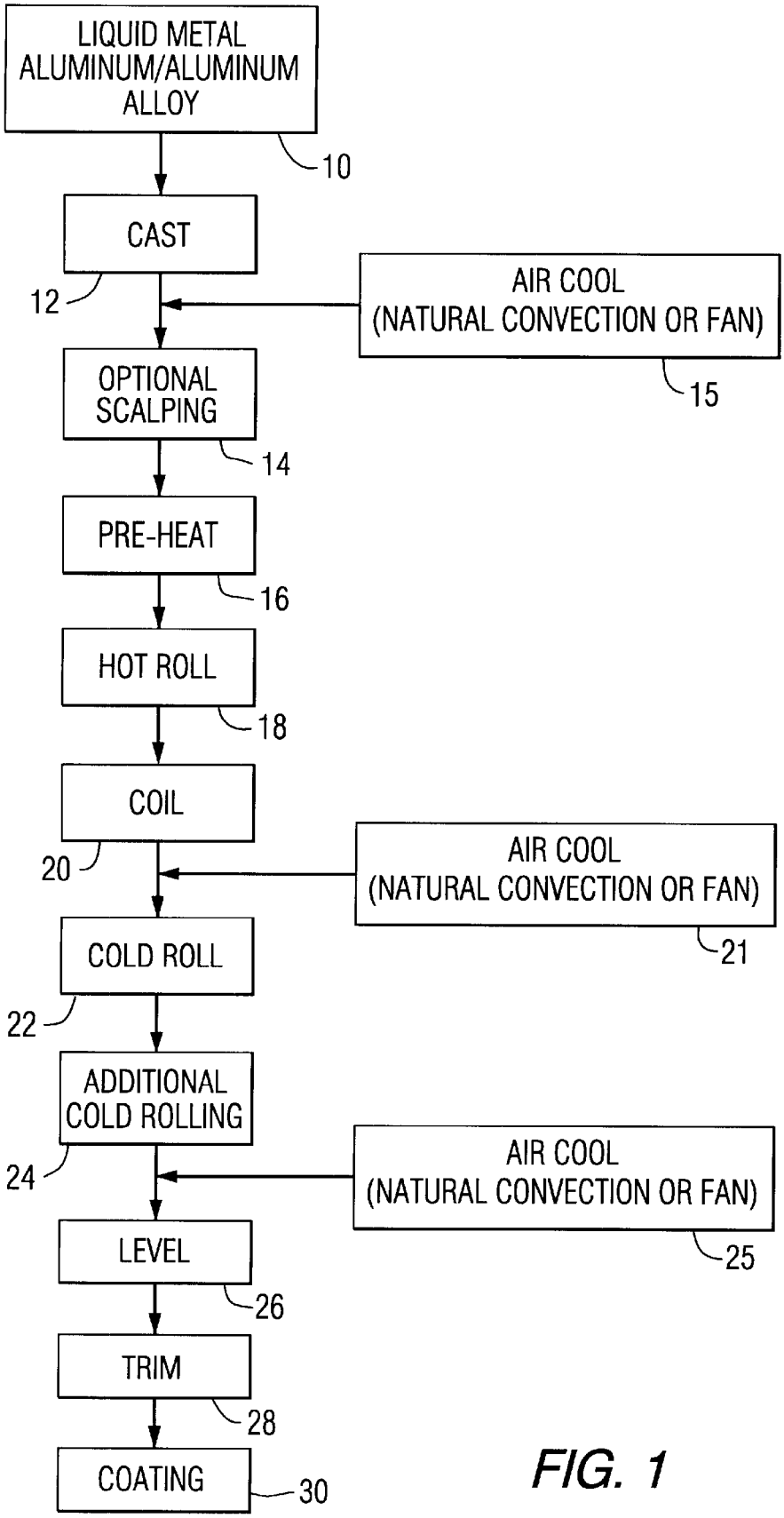
FIG. 1 is a schematic block diagram of one embodiment of the method of this invention.

Referring now to FIG. 1, molten aluminum metal 10, which can be melted aluminum scrap which has been magnetically separated, for example to remove iron and steel contaminants, at about 716° C. (1,320° F.), is passed through a casting device 12, preferably a direct chill casting apparatus or machine, to provide an aluminum ingot. Suitable alloys for the practice of the present invention include aluminum-manganese alloys of the AA 3,000 series; aluminum-magnesium alloys of the AA 5,000; and aluminum-magnesium-silicon alloys of the AA 6,000 series. Preferably the aluminum ingot is 3004 aluminum alloy which contains about 0.8–1.3% Mg, 1.0–1.5% Mn, 0.7% Fe and 0.3% Si, 0.25% Cu, 0.25% Zn, up to 0.15% others and remainder Al; or 5052 aluminum alloy which contains about 2.2–2.8% Mg, 0.1% Mn, 0.4% Fe, 0.25% Si, 0.1% Cu, 0.15–0.35% Cr, 0.1% Zn, up to 0.15% others and remainder Al. Any aluminum alloy containing at least 95.75% Al and at least 0.1% Mn and 2.2% Mg; or at least 95.55% Al and at least 1.0% Mn and 0.8% Mg is useful. The preferred direct chill (D.C.) casting of ingot is well known in the art and, for example, can be any of those processes described in the Jacoby et al. patents previously mentioned, for example U.S. Pat. No. 4,709,740, herein incorporated by reference; although the Jacoby patent deals with the DC casting of Al—Li alloys and uses a hydrocarbon coolant with minimal water (moisture) content, whereas our preferred process for DC casting utilizes water as the primary component with some additives.

Figure 2:
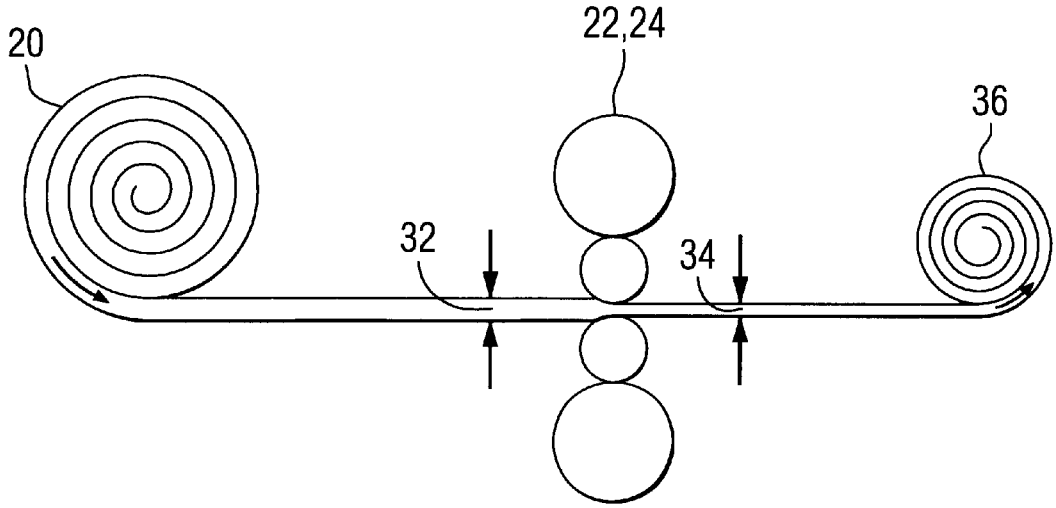
FIG. 2 is a schematic diagram detailing the cold rolling steps.

The ingot is then cooled 15 by natural convection or a fan to ambient temperatures to allow the optional "scalping" of the surface in step 14. This is a process in which at least two opposing faces of the ingot are machined. The removal of the material may be necessary to produce a smooth rolling surface and to remove the liquation zone from the surface left from the casting operation. In some cases this scalping step may be eliminated if unusually smooth surfaces result from the casting. Next, the prepared ingot heated 16 to a hot rolling temperature, about 540° C. (1,000° F.) and passed through hot rolls 18 to provide the thick sheet desired, about 3.2 to 5.8 mm. As shown in FIGS. 1 and 2, the sheet is then coiled into a coil 20 from about 1 to 2.7 meters in diameter and cooled via natural convection or forced air, with no water. The cooling 21 is to above ambient temperature, preferably 54° C. to 60° C. (129° F. to 140° F.). This cooling step 21 (shown by arrows in FIG. 2) before uncoiling for cold milling in step 22 and step 24 is critical.

After cooling, the sheet 32 having a minimum thickness of about 2.5 mm is cold rolled at least once in step 22, and optionally twice or more as in step(s) 24 to a maximum thickness of about 1.5 mm. Also, the final cold rolled sheet is finally cooled in step 25. The minimum reduction is from 2.5 mm to 1.5 mm or 40% with a maximum reduction of from 5.8 mm to 0.9 mm or 84%. Very importantly, the use of thick sheet 32 cooled to a maximum temperature of 60° C. coupled with dramatic 40% to 84% cold reduction to a minimum exit temperature of 120° C., providing at least a temperature increase of 60° C., and up to 110° C. (50° C. to 160° C.) in a short time span of about less than 30 minutes, generates sufficient heat to stabilize the aluminum/aluminum alloy sheet without furnace or other type annealing. As previously described the term "stabilize" as used herein is defined as a low temperature thermal treatment designed to prevent age-softening in strain hardened aluminum alloys containing magnesium. The finally reduced sheet 34 is then wrapped into a suitably sized coil 36 and cooled, to less than, preferably, 54° C. In optional step 26 the sheet is tension leveled, that is, a process designed to level, or mechanically flatten, by continuously stretching uniaxially with the assistance of bending, and then trimmed in step 28. If desired, the sheet can be finally coated in step 30 with a paint, epoxy or other resin with or without filler particles and baked to cure, then usually rolled into a coated coil for shipment.

The following example is presented to help illustrate the invention, and should not be considered in any way limiting.

EXAMPLE

Aluminum stock, primary and scrap, was melted and alloyed. The alloy contained at least 95.75% aluminum. The molten aluminum alloy was then cast using a direct chill caster (Wagstaff caster), into ingots measuring from 760 cm (300 inches) in length, 56 cm (22 inches thick), and 137 cm (54 inches) wide. Once cast, the ingots were then allowed to cool to ambient temperatures, about 22° C.

The ingots were prepared for hot rolling by scalping two opposing surfaces for a smooth surface from about 56 to 51 cm (22 inches to 20 inches). The scalping operation was simply a machining operation designed to remove rough surface from the ingot. Some direct chill casting offer surfaces that are smooth enough to skip this step.

The scalped ingots were then loaded into a furnace and heated to about 540° C. (1000° F.). Once the ingot had been allowed enough time to fully come to temperature, the ingot was then presented to the hot mill. The ingot was then passed through the hot mill, (Davy 4 high reversing hot mill.) The ingot was subjected to 21 passes. Once at final gauge of 4.06 mm (0.160 inches), the coil was removed from the mill to allow for further processing of ingots. The coil exits the hot mill from 290° C. to 345° C. (550° F. to 650° F.). Once in coil form, the coil was then cooled. The cooling was then supplemented by fan to decrease the time required for natural convection cooling in air to any temperature below 60° C. (140° F.). This is an internal quality control temperature to prevent scratches at the cold mill operation down stream.

Once cool, the coil was transferred to the cold mill (a single stand non-reversing Davy). The cold mill, in the second pass reduced the thickness further to about 1.2 mm (0.0475 inches) with a temperature of about 150° C. (300° F.).

Once cool, the coil was subjected to further operations to meet customer specifications. The coil was trimmed to 124.5 cm (49 inches) wide and leveled to a particular flatness and coil-set. After the level/trim operation, the coil was coated with a top and bottom coat. The coating was an epoxy with a certain color and hardness specification that is applied to the coil via roll coater and exposed to heat for cure before being packaged for shipment to the customer.

This process met all expectations and provided excellent results without using an annealing step, thus saving time and costs as well as reducing energy requirements. The process essentially followed the process set forth in FIGS. 1 and 2.

The present invention may be modified in other forms without departing from the spirit or essential attributes thereof, and accordingly reference should be made to both the appended claims and the foregoing specification as indicating the scope of the invention.

What is claimed is:

1. A process for producing thick aluminum sheet consisting of:

(1) casting an aluminum alloy ingot;

(2) cooling the ingot;

(3) heating the ingot to from 500° C. to 600° C.;

(4) hot rolling the ingot to a coilable sheet having a thickness of from 3.2 mm to 5.8 mm;

(5) wrapping the hot sheet into a coil;

(6) cooling the coiled sheet to less than 60° C.;

(7) cold rolling the cooled sheet from the coil between two opposing rolls to reduce the thickness to 0.9 mm to 1.5 mm and to provide the sheet with a temperature of from 120° C. to 160° C., where heat is generated during the cold rolling stabilizing the sheet;

(8) wrapping the reduced sheet into a coil; and (9) cooling the coiled sheet.

2. The method of claim 1, wherein in step (1) the ingot is direct chill cast and then scalped to provide a smooth surface suitable for hot rolling and after step (9) the sheet is leveled and the edges trimmed to a desired width.

3. The method of claim 1, wherein after step (9) the sheet is coated with a protective material.

4. The method of claim 1, wherein in step (7) the cooled sheet is cold rolled at least twice so that total reduction during that step is at least 40%.

5. The method of claim 1, wherein on step (7) the cooled sheet is cold rolled at least twice and the minimum temperature change from before to after the step is about 60° C.

6. The method of claim 1, wherein the aluminum alloy ingot contains at least about 95.75% Al, 0.1% Mn and 2.2% Mg.

7. The method of claim 1, wherein the aluminum alloy ingot contains at least about 99.5% Al, 1.0% Mn and 0.8% Mg.

8. The method of claim 1, wherein the aluminum alloy ingot contains about 0.8–1.3% Al, 1.0–1.5% Mn, 0.7% Fe, 0.3% Si, 0.25% Cu, 0.25% Zn, up to 0.15% others and remainder Al.

9. The method of claim 1, wherein the aluminum alloy ingot contains about 2.2–2.8% Mg, 0.1% Mn, 0.4% Fe, 0.25% Si, 0.1% Cu, 0.15–0.35% Cr, 0.1% Zn and up to 0.15% others, and remainder Al.

10. The method of claim 1, wherein there is no furnace annealing step.

11. The method of claim 1, wherein during step (7), the low temperature thermal treatment prevents age-softening.

12. The method of claim 1, wherein in step (7) the sheet is cold rolled so that total reduction during that step is from 40% to 84%.

13. The method of claim 1, wherein in step (7) the cooled sheet is cold rolled at least twice and the temperature change from before to after the step is from 60° C. to 110° C.

* * * * *